US006652386B1

(12) United States Patent
Sievänen et al.

(10) Patent No.: US 6,652,386 B1
(45) Date of Patent: Nov. 25, 2003

(54) SUBSTRUCTURE OF A BOWLING LANE

(75) Inventors: Mikko Sievänen, Tampere (FI); Joni Hietala, Vuorentausta (FI)

(73) Assignee: System-300 Group Oy, Tampere (FI)

( * ) Notice: Subject to any disclaimer, the term of this patent is extended or adjusted under 35 U.S.C. 154(b) by 0 days.

(21) Appl. No.: 09/959,822

(22) PCT Filed: May 4, 2000

(86) PCT No.: PCT/FI00/00392

§ 371 (c)(1),
(2), (4) Date: Jan. 4, 2002

(87) PCT Pub. No.: WO00/71215

PCT Pub. Date: Nov. 30, 2000

(30) Foreign Application Priority Data

May 10, 1999 (FI) ..... 991064

(51) Int. Cl.[7] ..... A63D 1/04
(52) U.S. Cl. ..... 473/115; 52/653.1; 52/656.9
(58) Field of Search ..... 473/115, 116; 52/650.1, 650.3, 653.1, 655.1, 656.9, 570, 571, 561, 648.1

(56) References Cited

U.S. PATENT DOCUMENTS

| | | | | |
|---|---|---|---|---|
| 3,186,712 | A | | 6/1965 | Kessler |
| 3,476,387 | A | | 11/1969 | Cepluch |
| 3,601,432 | A | * | 8/1971 | Fenwick |
| 3,697,034 | A | * | 10/1972 | Shell |
| 3,858,988 | A | * | 1/1975 | Cohen |
| 3,927,498 | A | | 12/1975 | Benedetti |
| 4,004,856 | A | * | 1/1977 | Wesseler |
| 4,122,645 | A | * | 10/1978 | Tooley |
| 4,144,690 | A | * | 3/1979 | Avery |
| 4,169,602 | A | | 10/1979 | Heddon |
| 4,406,455 | A | | 9/1983 | Berry et al. |
| 4,580,780 | A | | 4/1986 | Gautraud et al. |
| 4,779,868 | A | | 10/1988 | Ayre, Jr. |
| 4,801,143 | A | * | 1/1989 | Heddon |
| 4,913,433 | A | * | 4/1990 | Rochefort ..... 473/117 |
| 4,971,281 | A | * | 11/1990 | Steinbeck |
| 5,488,809 | A | * | 2/1996 | Lindsay ..... 52/653.1 |
| 5,862,635 | A | * | 1/1999 | Linse et al. |
| 6,098,358 | A | * | 8/2000 | Waalkes et al. |
| 6,256,939 | B1 | * | 7/2001 | Snyder |
| 6,301,854 | B1 | * | 10/2001 | Daudet et al. ..... 52/650.1 |
| 6,407,351 | B1 | * | 6/2002 | Meyer et al. |

FOREIGN PATENT DOCUMENTS

| | | |
|---|---|---|
| DE | 3437822 | 4/1986 |
| DE | 4422629 | 2/1996 |
| FI | 41777 | 7/1968 |
| GB | 2172628 | 9/1986 |

* cited by examiner

*Primary Examiner*—William M. Pierce
(74) *Attorney, Agent, or Firm*—Swidler Berlin Shereff Friedman, LLP

(57) ABSTRACT

The invention relates to a substructure of a bowling lane, which comprises a framework composed of beams (1, 2, 3). The horizontally installed beams (1, 2) of the substructure have first and second fixing means (FE, SE) and beams (1, 2) are attached together by connecting the first and second fixing means (FE, SE) of the beams (1, 2).

9 Claims, 6 Drawing Sheets

SUBSTRUCTURE OF A BOWLING LANE

Figure 1:
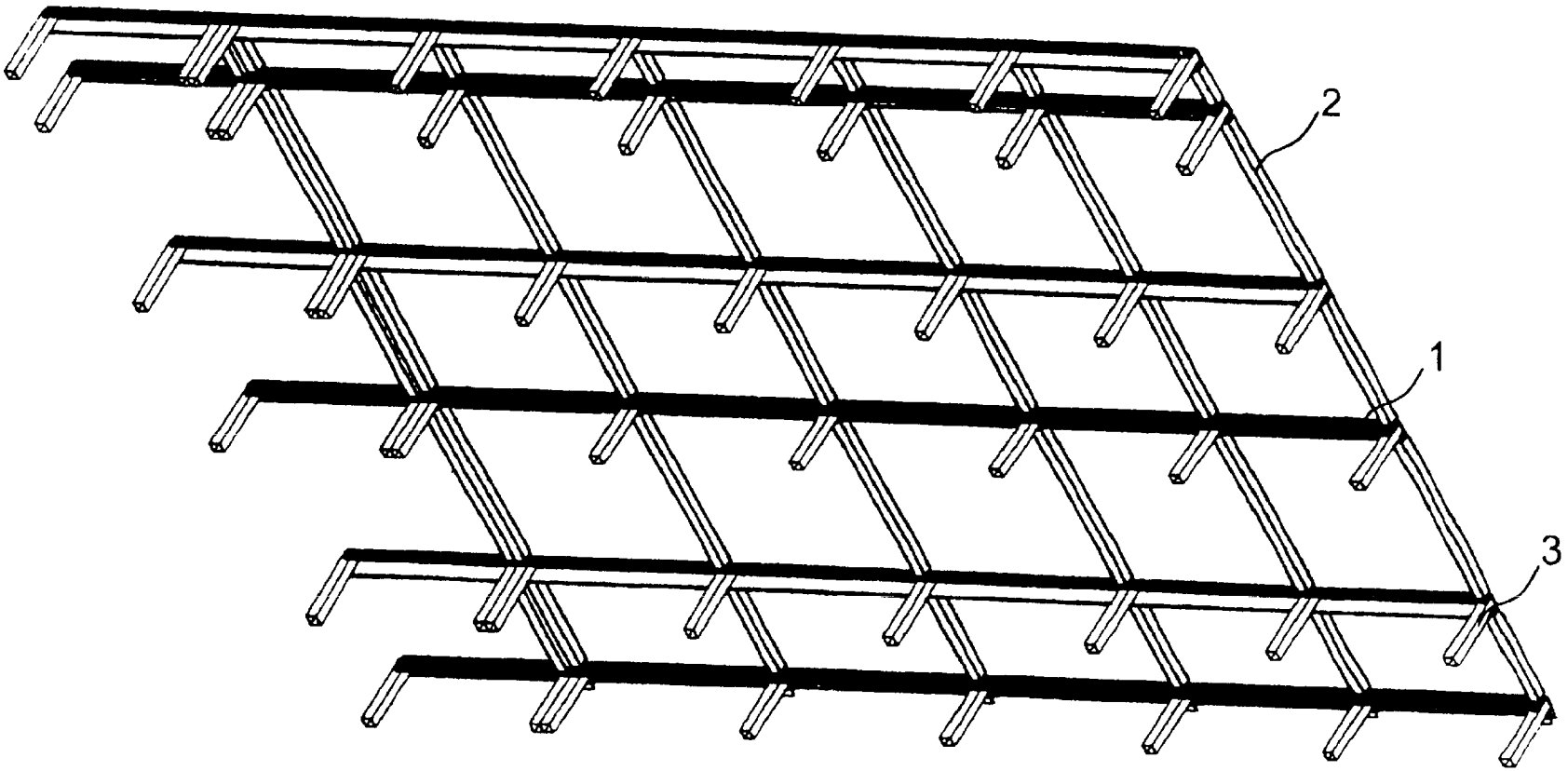

The present invention relates to a substructure of a bowling lane, an attachment of a channel, so-called gutter extending on both longitudinal edges of the bowling lane, to the substructure of the bowling lane, and to a height adjustment part for the substructure of the bowling lane. The substructure of a bowling lane comprises a framework on top of which the bowling lane is mounted. The scope of the invention also covers substructures for other pin games, for example the substructures of so-called Kegel lanes. The dimensions of Kegel lanes differ from those of ordinary bowling lanes to some extent.

Known bowling lane substructures are presented for example in the publications U.S. Pat. No. 4,169,602 and U.S. Pat. No. 4,580,780. The publication U.S. Pat. No. 4,169,602 presents a bowling lane with a modular construction, in which the substructure from the foundation of the building onwards comprises wooden beams set across the bowling lane, beams of 2×10 inches placed on top of said beams in the longitudinal direction of the bowling lane, and further, beams placed crosswise on top of the aforementioned beams, on top of which the bowling lane is mounted.

The substructure according to the publication U.S. Pat. No. 4,580,780 is composed of horizontal and vertical beams, between which there are diagonal beams. The aim is, for instance, to attain a dimensionally stable substructure of low price.

At present, the applicant manufactures the substructure of a bowling lane in such a manner that a trussed construction is composed of wooden beams by sawing the timber at the location of installation to a fixed length, thereafter joining the parts together by means of screws and/or nails. This manner is also common among other manufacturers.

Prior art attachment of the gutter to the bowling lane is introduced in U.S. Pat. No. 4,406,455. In its edge, the gutter contains a groove, in which U-shaped hooks are attached, the other end of which is supported under a beam in the substructure.

Prior art height adjustment is introduced in U.S. Pat. No. 4,779,868. The publication presents two different height adjustments. One height adjustment is located in the upper end of vertical beams of the substructure, and it is implemented by means of threads. The other height adjustment is located against the foundation of the building. Close to the upper surface of the foundation there are horizontal beams, to which the substructure above them is attached. Under the horizontal beams there are small plate-like parts, which are attached to the horizontal beams by means of adjustment screws. By means of adjustment screws it is possible to adjust the height of the plate-like parts with respect to the horizontal beams.

A problem occurring in prior art substructures of bowling lanes is that the substructure is assembled at the location of installation, and it cannot be disassembled after the installation so that it could be assembled again. The gutters are also fixed with nails, screws or other corresponding fastening means, wherein they cannot be easily detached either. The height adjustment is either non-existent or it is implemented with very complex structures. If there is no height adjustment, it may be necessary to for example to grind the surface of the bowling lane in order to level off the variations in height.

The substructure for a bowling lane according to the invention is of such a quality that it can be assembled rapidly at the location of installation, and it can also be disassembled in such a manner that it can be assembled again. Thus, the substructure of a bowling lane according to the invention is characterized in that the horizontally installed beams of the substructure are attached to each other by connecting the first and second fixing means.

The attachment of the gutter according to the invention to the substructure of the bowling lane is simple and it can be easily implemented. The attachment of the gutter according to the invention is characterized in that the gutter is attached to the first fixing means.

The part of the substructure of a bowling lane according to the invention enables fine adjustment of the height of the substructure in the bowling lane, thus facilitating the installation work. The part of the substructure of a bowling lane according to the invention is characterized in that it is arranged to adjust the height of the vertical beams in the substructure of the bowling lane.

The substructure according to the invention can be installed easily and rapidly, because the first and second fixing means of the beams form counterparts for each other, and thus they can form a joint without a separate working process. The beams have a fixed size when they are transported to the site of installation, and thus it is not necessary to cut them at the site of installation. Thus, sawing waste or the like to be cleaned up and transported away is not produced either.

Because nails or corresponding fastening means are not required for the attachment of the beams, the substructure can be disassembled without damaging the same. Thus, by using a substructure according to the invention, bowling lanes can be assembled temporarily for example for different events or the like, which has not been worthwhile until now.

The attachment of the gutter according to the invention is simple and easy to implement, because nails, screws or other corresponding fastening means are not required in the attachment of the gutter.

The part of the substructure of a bowling lane according to the invention accelerates the installation work, because the fine adjustment of the height can be implemented in this manner. Thus, for example the surface of the bowling lane does not have to be ground to level off the variations in height.

Figure 3:
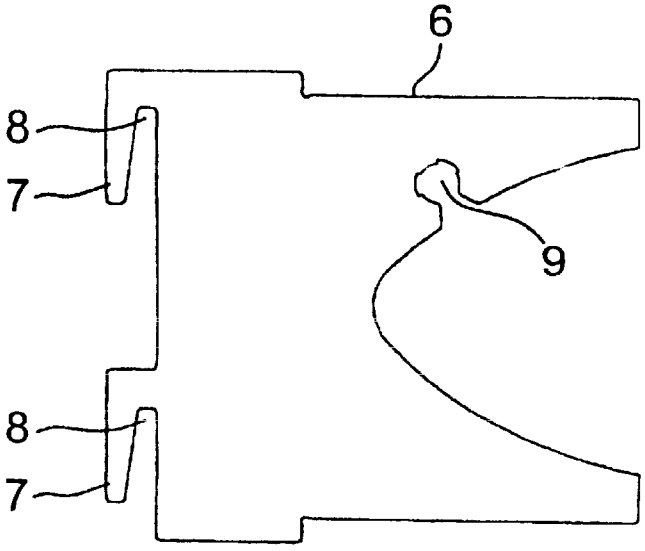
Figure 2:
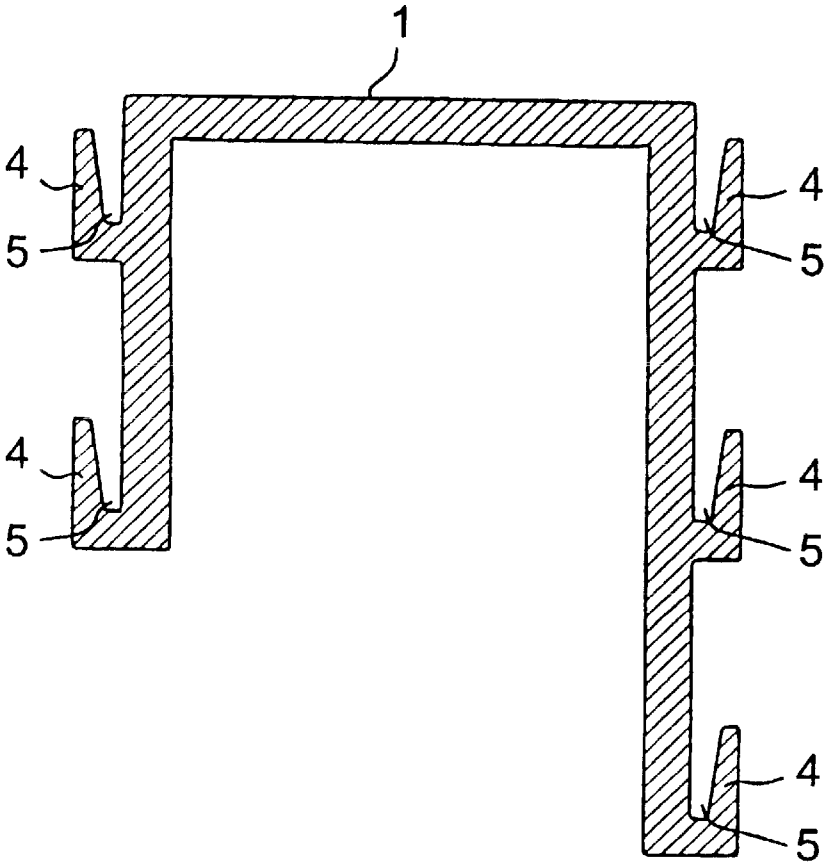
Figure 4:
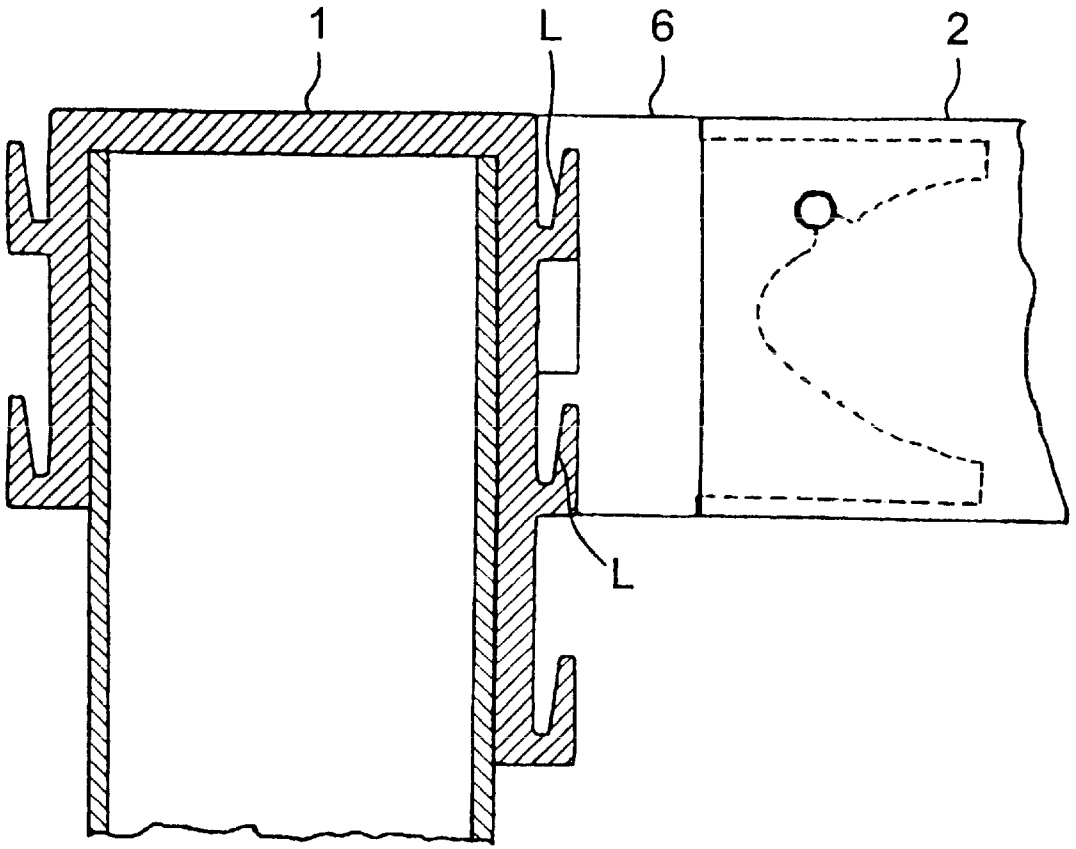
Figure 5:
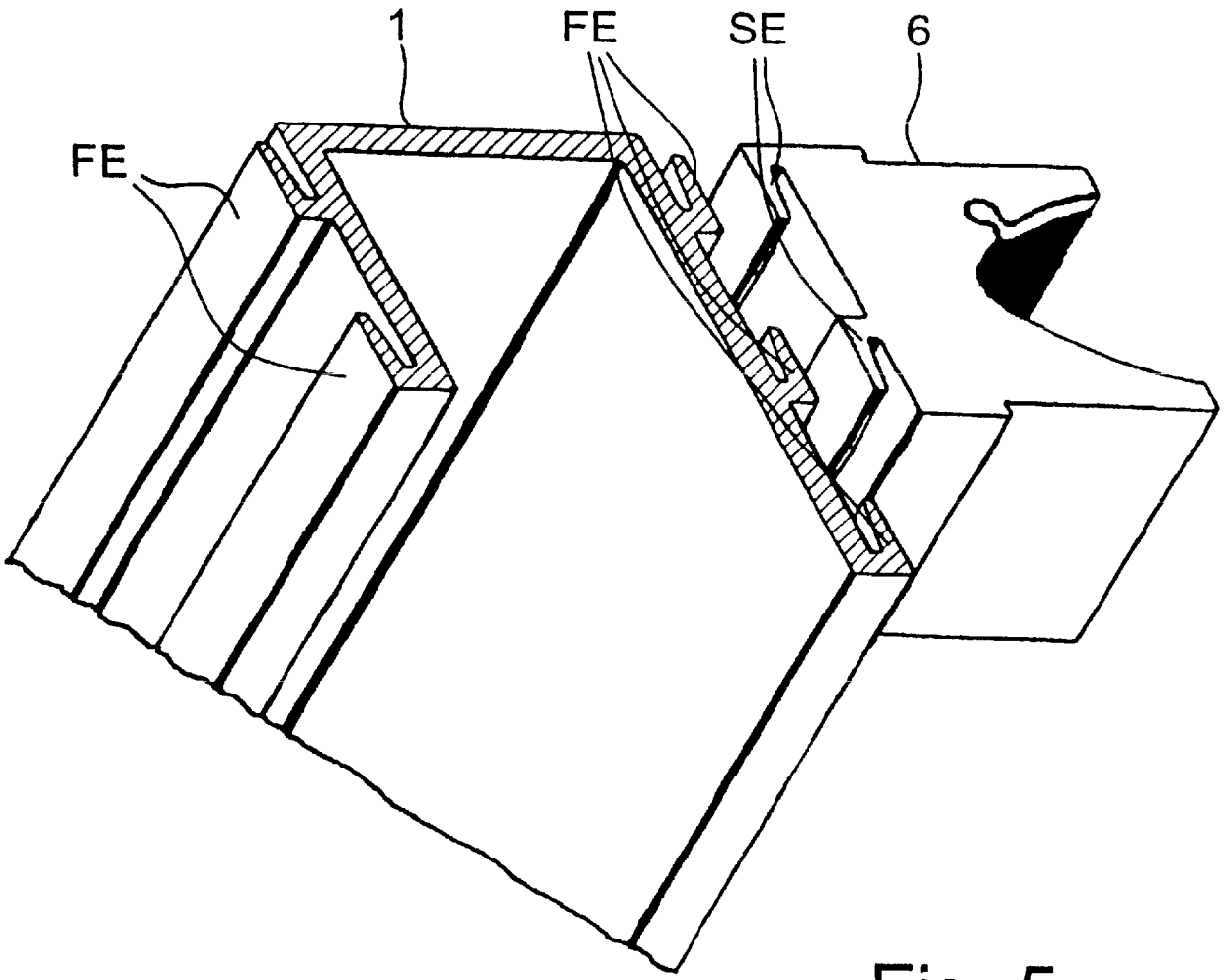
Figure 6:
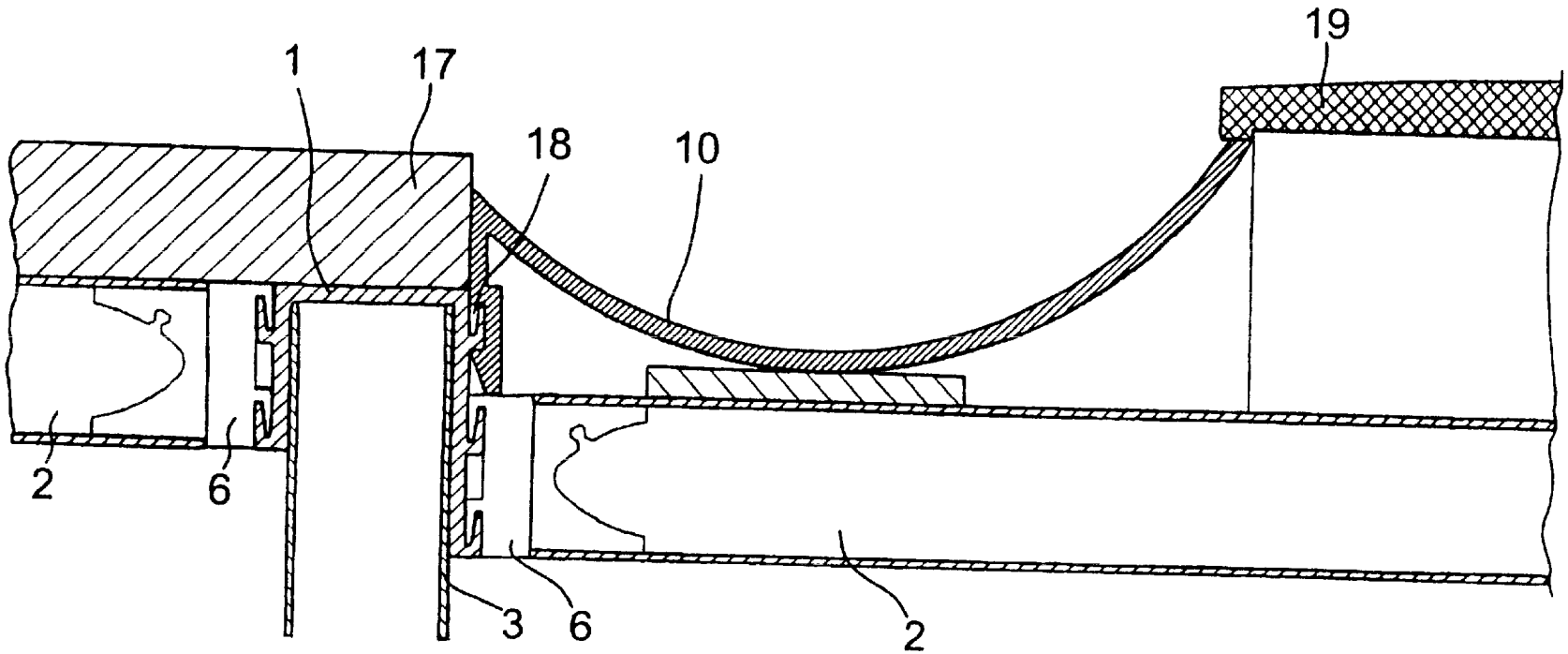
Figure 7:
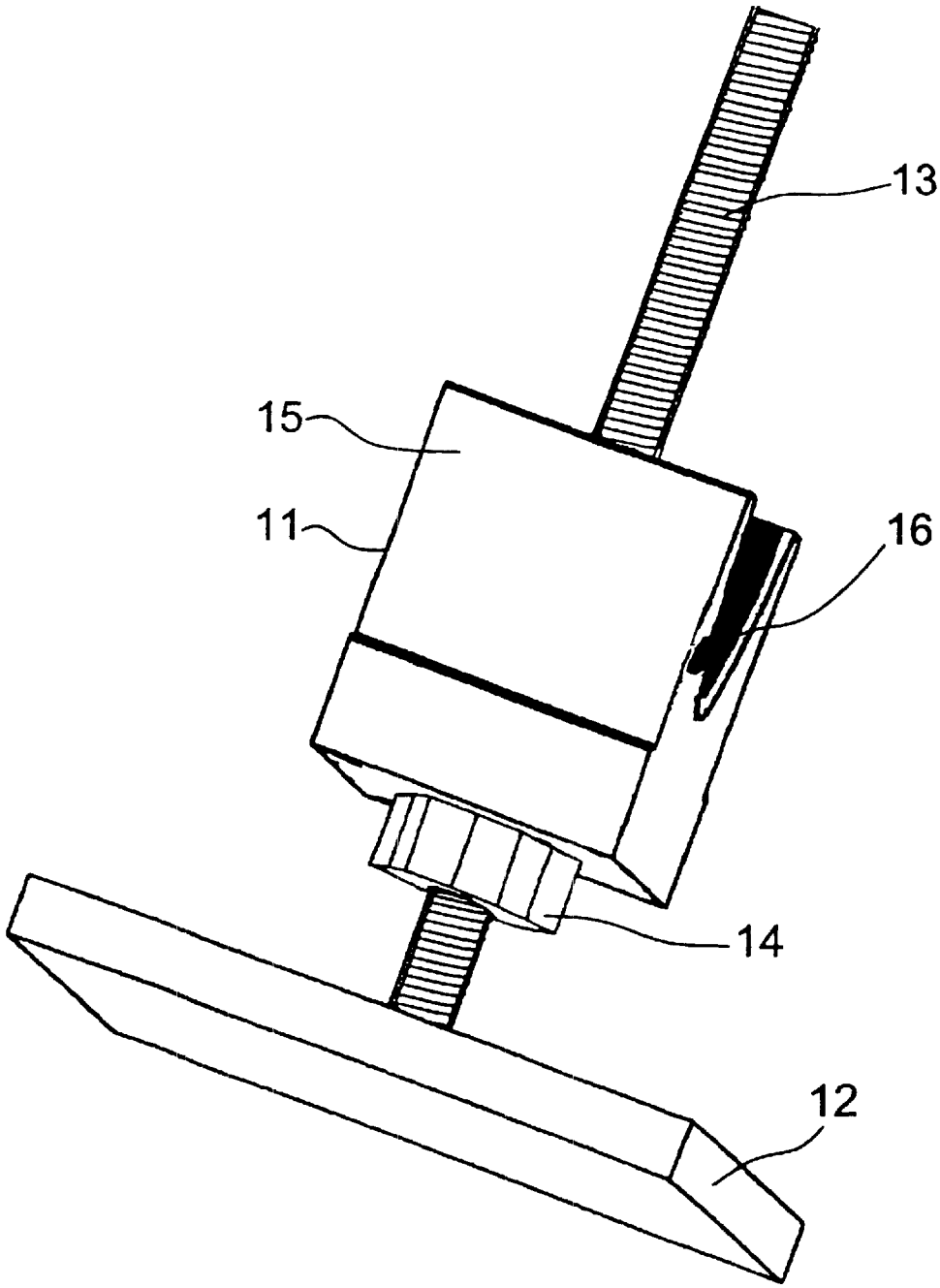

In the following, the invention will be described in more detail with reference to the appended drawings, in which FIG. 1 shows a substructure of the bowling lane at the point of location of the approach lane, as seen from underneath the bowling lane, FIG. 2 shows the cross-section of a beam extending on the entire area of the bowling lane, FIG. 3 shows a side-view of an assembly part for a beam, located between two continuous beams of the bowling lane, FIG. 4 shows the fixing point of a beam located between the beam extending on the entire area of the bowling lane and the two continuous beams of the bowling lane, FIG. 5 shows a perspective view of a beam extending on the entire area of the bowling lane and an assembly part located between the two continuous beams of the bowling lane, FIG. 6 shows a cross-section of the bowling lane structure, and FIG. 7 shows a perspective view of a height adjustment part to be mounted to the lower end of the vertically installed beam of the bowling lane.

In the longitudinal direction of a single bowling lane, the lane includes an approach lane, a ball track and a pin deck on which the pins to be bowled down stand erect. On the side of each single bowling lane there is a gutter, along which the bowling ball travels if it falls out of the track. Furthermore, the lane contains machines which are arranged for example to take care of keeping the scores and lifting the pins up.

The entire bowling lane is composed of sections in the lateral direction in such a manner that there are two gutters between the bowling lanes. Underneath the entire bowling lane there is a substructure, which is an object of the present invention. The ball is returned in the space underneath the gutters in such a manner that returning of balls of two lanes takes place in the same space. Thus, space for the ball return is required only underneath every other pair of gutters. On top of the substructure, bowling lane panels are mounted by means of a suitable attachment, which bowling lane panels can be several superimposed panel layers or bowling lane elements composed of a multiple layer structure. Between the panel layer or lane element and substructure there may be a material, for example a rubber mat or the like, as a cushioning layer.

According to FIG. 1, the substructure of the bowling lane comprises beams 1 extending in the longitudinal direction of the bowling lane, beams 2 extending in the lateral direction of the bowling lane and vertical beams 3 supporting the bowling lane. The beams are connected to each other in such a manner that they form a three-dimensional trussed structure. The substructure can also contain diagonal beams the fixing means of which are manufactured in view of diagonal installation.

All beams 1, 2 and 3 are made of a material which is dimensionally stable, does not react to changes in humidity conditions, and is sufficiently durable. A suitable material is metal, for example aluminium or a corresponding material. The beams can be made for example by means of extrusion technology, in which the molten aluminium is pressed through a die whose shape corresponds to the structure that is being manufactured, in such a way that the desired profile is attained. The extruded beams can be sawed into pieces of suitable size, for example to produce the assembly parts and height adjustment parts.

The use of aluminium is advantageous for example in that respect that an aluminium structure is not sensitive to variations in humidity. Thus, differences in height or distortions do not occur in the bowling lane because of the changes in the humidity. This is important because a height difference of 0.635 mm (1/40") at the most is allowed in the splices of the lane elements to be fixed on the substructure of the bowling lane. Aluminium is a relatively durable and light material, and thus not a very large amount of material is required and the beams are relatively light to transfer.

The substructure of the bowling lane is advantageously of such a type that the beams extending to one direction horizontally are continuous within the entire area of the lane. A continuous beam may be installed either in the longitudinal or lateral direction of the lane. The beam 1 extending in the longitudinal direction of the bowling lane in the substructure of the bowling lane shown in FIG. 1, is an aluminium profile beam continuous over the entire length of the lane, the cross-section of which is shown in FIG. 2. On both side surfaces of the beam 1 there are first fixing means FE which are composed of a groove 5 opening upward and a side wall 4 of the same. The fixing means function as hook-like fixing means, and the function of the same is described hereinbelow.

FIG. 3 shows an assembly part 6 for the beam 2 extending in the lateral direction of the bowling lane 3. The assembly part 6 is fixed to the end of the constant profile aluminium beam 2 in such a manner that one end of the assembly part 6 remains inside the constant profile beam 2, as shown in FIG. 4. The beams 2 are hollow, enabling the installation of the assembly part 6.

The assembly part 6 is fixed to the end of the constant profile aluminium beam 2 in such a manner that a hole is drilled in the side surface of the beam 2, the hole being concentric with a recess 9 in the assembly part 6 when the assembly part 6 has been fixed in its place and a screw or the like extends through the hole, attaching the assembly part 6 and the beam 2 together. There are two assembly parts 6 for one beam 2, one in each end.

In the end surface of the assembly part 6 there are second fixing means SE which are composed of grooves 8 opening downwards and the side walls 7 of the same. These fixing means also function like hook-like fixing means. When the assembly part 6 is connected to the beam 1, a male-female connection L according to FIG. 4 is produced, in which the first fixing means FE of the beam 1 and the second fixing means SE of the assembly part 6 are connected. To facilitate the connecting process, the inner surfaces of the side walls of the abutting fixing means are inclined with respect to the vertical plane in such a manner that the groove expands towards the opening direction. The upper surfaces of the beams 1 and 2 are on the same level, wherein the beams extending both longitudinally and laterally in the bowling lane support the panels of the bowling lane mounted on the substructure.

In FIG. 5 the assembly part 6 and the beam 1 are shown in a perspective view to illustrate the first fixing means FE and the second fixing means SE. The grooves 5 and 8 can be supplemented for example with sealing and cushioning material, but they can also be connected together as such. The grooves 5 and 8 advantageously have a shape as shown in the drawings, wherein the juncture L will automatically be tightened when the first fixing means FE and the second fixing means SE are connected together because of the diagonal surfaces placed against each other and extending in the same angle.

Because the beam extending on the entire area of the bowling lane can be installed either in the longitudinal direction or in the lateral direction, the first fixing means FE refer in this application to the fixing means of the continuous beam 1, and the second fixing means SE to the fixing means of the horizontal beam 2 which is placed between two continuous beams, perpendicularly to the beam 1, irrespective of the direction in which the beams are installed with respect to the bowling lane. The fixing means of the beams refer both to the first fixing means FE and to the second fixing means SE, and the fixing means of the beam can be a part integrated in the beam, or a part integrated in the assembly part to be connected to the beam.

The vertical beams 3 of the bowling lane are placed in an upright position in a recess underneath the beam 1 according to FIG. 4. The attachment of the vertical beam is ensured by drilling a hole through the beams 1 and 3 in such a manner that they can be connected perpendicularly to each other by means of bolts or the like. The upper ends of the vertical beams can be placed steadily in the beam 1 because the beam has a cross-section of a U turned upside down.

The continuous beam 1 has in its one side surface advantageously two horizontal first fixing means FE within a particular, vertical distance from each other, and in its other side surface three similarly positioned first fixing means FE. The second fixing means SE are in the same vertical distance from each other as the first fixing means FE. In the assembly part 6 there are advantageously two second fixing means SE. However, the number of the first fixing means FE in the beam 1 and the number of the second fixing means in the assembly part 6 can vary. The continuous beam has fixed cross-section over a long distance, i.e. it is a so-called profile piece. Because of the installation it may be necessary to place the continuous beams successively to form a structure which extends through the bowling lane. The first fixing means FE advantageously extend over the entire length of the beam 1, but they can also be positioned periodically in the side surface of the beam 1. The second fixing means SE advantageously extend over the width of the side surface in the end of the beam 2, but they can also be positioned periodically in the end surface of the beam 2.

At the location of the gutter 10, the assembly part 6 can be connected to two lower first fixing means FE according to FIG. 6, wherein a space is formed for the gutter 10 on the upper surface of the substructure. The gutter 10 can thus be connected to the upper first fixing means FE without separate fastening means. In the structure of the gutter 10 there is a continuous recess 18 opening in the lateral direction within the entire length of the gutter, being compatible with the first fixing means FE. The beam 2 supports the gutter from underneath. FIG. 6 illustrates how the lower edge of the gutter, which is underneath the recess 18, rests on top of the assembly part 6 of the beam 2. The other end of the gutter 10 is locked into its position underneath an element 19 separating the two gutters. In the area of the approach lane where there are no gutters 10, the assembly part 6 is fixed to two upper first fixing means FE. The construction element of the bowling lane is shown with the numeral 17 in FIG. 6, and it is connected to the substructure by means of a suitable fixing method.

Because the construction of the bowling lane is sectional in the lateral direction in such a manner that between two single bowling lanes there are two adjacent gutters, the continuous beam 1 must be installed in such a manner that three first fixing means FE are positioned on the side of the gutter 10.

The fine adjustment of the height of the lane is conducted in such a manner that a part according to FIG. 7 is mounted to the lower end of the vertical beam 3, the part being a height adjustment part. The height adjustment part 11 comprises a plate-like plane 12, a threaded rod 13, adjustment means 14 and a basic part 15. The end of the basic part 15 is installed inside a vertical constant profile beam 3, and a hole is drilled in the beam 3 in such a manner that the assembly part 11 and the beam 3 can be fixed together by means of bolts or the like at the location of a recess 16 in the assembly part. The adjustment means 14 can be for example nuts which can be moved in the vertical direction of the threaded rod by rotating, thus adjusting the height of the substructure. The height adjustment possibility is advantageously 0 to 20 mm. There are two adjustment means 14, one outside the basic part 15, and the other inside the basic part 15, wherein when they are screwed down to the basic part 15, they lock the height adjustment.

The above-presented substructure of the bowling lane, the attachment of the gutter, and the part of the substructure of a bowling lane, do not restrict the claims. The fixing means of the beams can be produced by some other manner as well, but in such a way, however, that the first and the second fixing means can be connected together. The material of the beams can be some other material than aluminium. In addition to the vertical and horizontal beams the construction can also contain diagonal beams, the fixing means of which lie in a position corresponding to the diagonal position. The beams installed between the continuous beams of the bowling lane do not necessarily consist of constant profile beams and assembly parts, but the assembly part may be integrated in the beam.

The fixing means can differ from that described above for example with respect to the shape of the groove. The first and the second fixing means does not have to be formed of grooves and side walls of the same, but other kinds of counterparts are also possible. Furthermore, the number of fixing means on different sides of the beam can vary, even though two and three fixing means on different sides of the continuous beam is an advantageous solution in view of the attachment of the beams positioned transversely with respect to the same on different levels of height and the attachment of the gutter above a beam to be placed on a lower position. The shape of the recess or the like in the gutter can also vary. The structure of the part of the substructure of the bowling lane, i.e. the structure of the height adjustment part can vary, and the height adjustment part does not necessarily have to be a separate part attached to the lower end of the vertical beam, but the height adjustment mechanism can be a part of the vertical beam.

What is claimed is:

1. A bowling lane structure, comprising:

a substructure comprising a framework comprising intersecting beams, the beams comprising a plurality of first horizontal beams extending in a longitudinal direction of the bowling lane;

a plurality of second horizontal beams extending in a transverse direction of the bowling lane;

first fixing means operatively attached to the first horizontal beams; and a gutter attached to the first fixing means.

2. The bowling lane structure according to claim 1, wherein the first fixing means comprises a groove opening upwards and extending in a horizontal direction in a side surface of the first horizontal beams.

3. The bowling lane structure according to claim 2, wherein the first fixing means are located on both side surfaces of the first horizontal beams.

4. The bowling lane structure according to claim 3, wherein the first fixing means are located on both side surfaces of the first horizontal beams within a given vertical distance with respect to each other.

5. The bowling lane structure according to claim 3, wherein on a first side surface there are a larger number of fixing means than on a second side surface.

6. The bowling lane structure according to claim 5, wherein on the first side surface there are two first fixing means and on the second side surface there are three first fixing means.

7. The bowling lane structure according to claim 1, wherein the gutter is connected to the first fixing means in such a at the recess in the gutter is connected to the first fixing means.

8. The bowling lane structure according to claim 7, wherein the recess is connected to the uppermost first fixing means in such a manner that the beam supports the gutter from underneath.

9. The bowling lane structure according to claim 1, wherein at least the beams of the substructure are made of aluminium.

* * * * *